US011835297B2

(12) United States Patent
Wang

(10) Patent No.: US 11,835,297 B2
(45) Date of Patent: Dec. 5, 2023

(54) HEAT EXCHANGER

(71) Applicant: DENSO CORPORATION, Kariya (JP)

(72) Inventor: Zihua Wang, Kariya (JP)

(73) Assignee: DENSO CORPORATION, Kariya (JP)

( * ) Notice: Subject to any disclaimer, the term of this patent is extended or adjusted under 35 U.S.C. 154(b) by 113 days.

(21) Appl. No.: 17/363,264

(22) Filed: Jun. 30, 2021

(65) Prior Publication Data

US 2021/0325116 A1 Oct. 21, 2021

Related U.S. Application Data

(63) Continuation of application No. PCT/JP2020/000819, filed on Jan. 14, 2020.

(30) Foreign Application Priority Data

Feb. 1, 2019 (JP) ..... 2019-016917

(51) Int. Cl.

| | |
|---|---|
| ***F28D 1/053*** | (2006.01) |
| ***F28F 9/013*** | (2006.01) |
| ***F28F 9/02*** | (2006.01) |
| ***F28F 9/26*** | (2006.01) |

(52) U.S. Cl.

CPC ..... *F28D 1/053* (2013.01); *F28F 9/0131* (2013.01); *F28F 9/0202* (2013.01); *F28F 9/262* (2013.01); *F28F 2275/04* (2013.01)

(58) Field of Classification Search

CPC ..... F28F 2275/04; F28F 9/262; F28F 9/0202; F28F 9/0131; F28D 1/053

See application file for complete search history.

(56) References Cited

U.S. PATENT DOCUMENTS

| | | | | |
|---|---|---|---|---|
| 2005/0039900 | A1 | 2/2005 | Yu | |
| 2012/0247742 | A1* | 10/2012 | Mizuno | F28D 1/05391 165/173 |
| 2014/0174702 | A1 | 6/2014 | Kurz et al. | |
| 2015/0168080 | A1 | 6/2015 | Honma et al. | |

(Continued)

FOREIGN PATENT DOCUMENTS

| | | | |
|---|---|---|---|
| CN | 104508418 | A | 4/2015 |
| JP | 3974605 | B2 | 9/2007 |
| JP | 2008304109 | A | 12/2008 |

(Continued)

OTHER PUBLICATIONS

Demeri (ASM Int'l, advanced high strength steels, Ch. 4.1).*

*Primary Examiner* — Devon Russell

(74) *Attorney, Agent, or Firm* — Harness, Dickey & Pierce, P.L.C.

(57) ABSTRACT

A heat exchanger includes: tubes stacked in a stacking direction, through which fluid flows; and a tank having a core plate to which each of the tubes is connected. The tank has a first space and a second space separated from each other and arranged in the stacking direction to store fluid. The core plate has insertion holes arranged in the stacking direction, through which the tubes are respectively inserted. The core plate has a boundary portion opposing a boundary between the first space and the second space. The core plate has a rigid portion that overlaps at least one of the insertion holes at a position adjacent to the boundary portion so as to increase a rigidity of the core plate.

17 Claims, 15 Drawing Sheets

(56) References Cited

U.S. PATENT DOCUMENTS

2018/0363987 A1* 12/2018 Itou ..... F28D 1/05375

FOREIGN PATENT DOCUMENTS

| | | | | | |
|---|---|---|---|---|---|
| JP | 2012215366 | A | | 11/2012 | |
| JP | 2014-519005 | A | | 8/2014 | |
| JP | 2017040457 | A | | 2/2017 | |
| JP | 2017106668 | A | * | 6/2017 | ..... F28D 1/0461 |
| JP | 2018169058 | A | * | 11/2018 | |
| JP | 6439454 | B2 | * | 12/2018 | |
| JP | 2018194179 | A | * | 12/2018 | |
| WO | WO-2010133491 | A1 | | 11/2010 | |

* cited by examiner

HEAT EXCHANGER

CROSS REFERENCE TO RELATED APPLICATIONS

The present application is a continuation application of International Patent Application No. PCT/JP2020/000819 filed on Jan. 14, 2020, which designated the U.S. and claims the benefit of priority from Japanese Patent Application No. 2019-016917 filed on Feb. 1, 2019. The entire disclosures of all of the above applications are incorporated herein by reference.

TECHNICAL FIELD

The present disclosure relates to a heat exchanger.

BACKGROUND

A vehicle is provided with a heat exchanger that exchanges heat between fluid and air. The heat exchanger includes a radiator to cool the fluid such as cooling water that has passed through an internal combustion engine by exchanging heat with air.

SUMMARY

A heat exchanger includes: tubes stacked in a stacking direction, through which fluid flows; and a tank having a core plate to which each of the tubes is connected. The tank has a first space and a second space separated from each other and arranged in the stacking direction to store fluid. The core plate has insertion holes arranged in the stacking direction, through which the tubes are respectively inserted. The core plate has a boundary portion opposing a boundary between the first space and the second space. The core plate has a rigid portion that overlaps at least one of the insertion holes formed at a position adjacent to the boundary portion so as to increase a rigidity of the core plate.

DESCRIPTION OF EMBODIMENT

Figure 1:
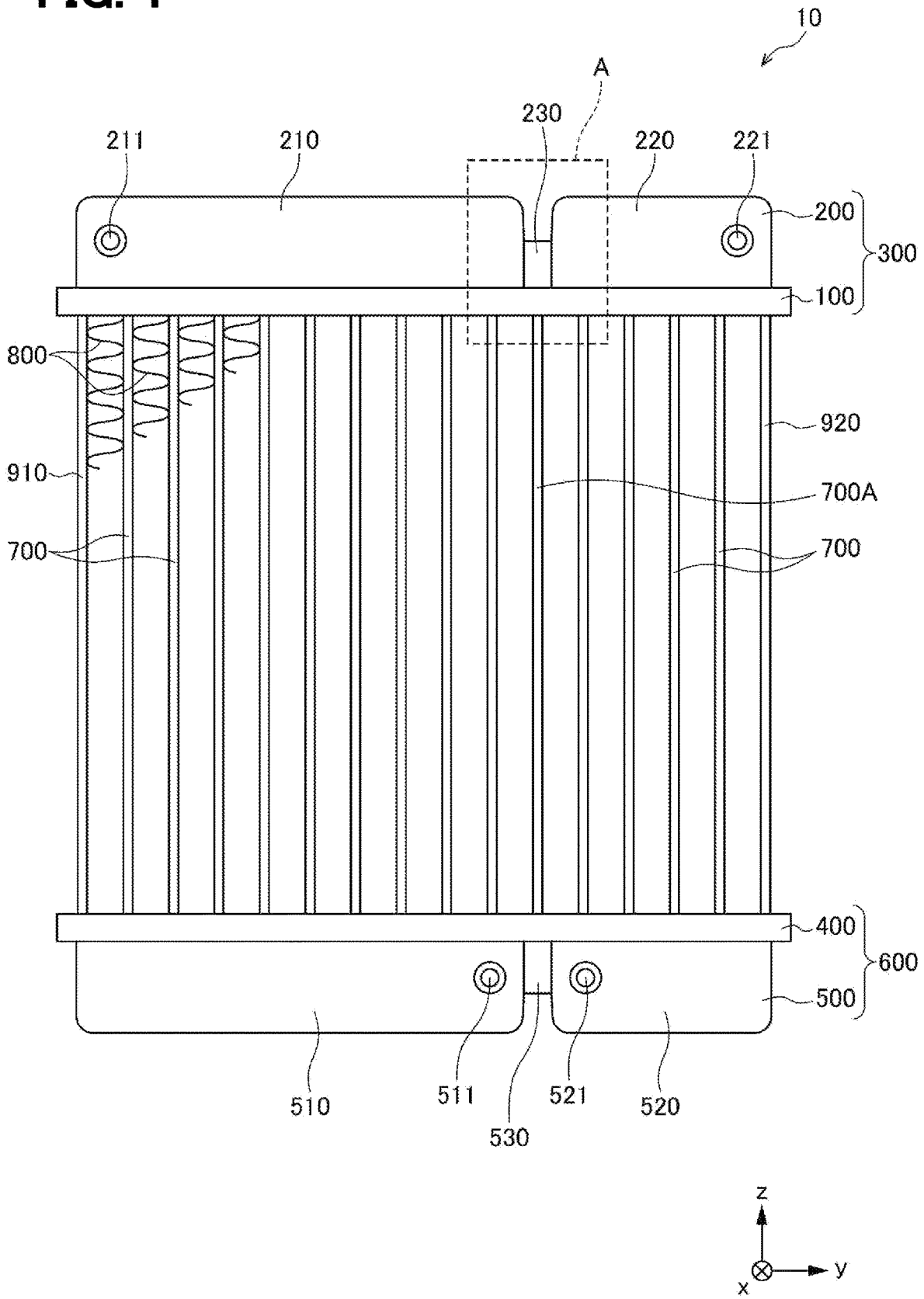
FIG. 1 is a schematic view showing an overall configuration of a heat exchanger according to a first embodiment.

To begin with, examples of relevant techniques will be described.

A vehicle is provided with a heat exchanger that exchanges heat between fluid and air. The heat exchanger includes a radiator to cool the fluid such as cooling water that has passed through an internal combustion engine by exchanging heat with air.

The heat exchanger includes a tank and tubes connected to the tank. Two spaces are formed inside the tank. High-temperature cooling water that has passed through the internal combustion engine is supplied to a first tank chamber which is one of the spaces. Low-temperature cooling water that has passed through an electric motor is supplied to a second tank chamber which is the other of the spaces.

In the heat exchanger, the tubes are connected to either the first tank chamber or the second tank chamber. High-temperature cooling water flows through the tube connected to the first tank chamber. Low-temperature cooling water flows through the tube connected to the second tank chamber. In the heat exchanger, two types of cooling water having different temperatures can be cooled by heat exchange with air.

In the heat exchanger, the tank includes a core plate to which each tube is connected. The core plate has insertion holes for inserting and brazing the tubes. In the heat exchanger, the tube through which high-temperature cooling water flows and the tube through which low-temperature cooling water flows are connected to a single core plate.

In the tube through which high-temperature cooling water flows, the longitudinal dimension of the tube tends to increase due to thermal expansion. In contrast, in the tube through which low-temperature cooling water flows, the longitudinal dimension of the tube does not increase significantly due to thermal expansion. Therefore, the force received by the core plate from the thermally expanding tube varies greatly depending on the location.

The core plate has a boundary portion facing the boundary between the first tank chamber and the second tank chamber. A large distortion tends to occur at or near the boundary portion by thermal expansion of the tube. As a result, some of the tubes joined to the boundary portion may be damaged.

The present disclosure provides a heat exchanger capable of suppressing distortion generated in the core plate.

A heat exchanger includes: tubes stacked in a stacking direction, through which fluid flows; and a tank having a core plate to which each of the tubes is connected. The tank has a first space and a second space separated from each other and arranged in the stacking direction to store fluid. The core plate has insertion holes arranged in the stacking direction, through which the tubes are respectively inserted. The core plate has a boundary portion opposing a boundary between the first space and the second space. The core plate has a rigid portion that overlaps at least one of the insertion holes formed at a position adjacent to the boundary portion so as to increase a rigidity of the core plate.

In the heat exchanger having the above configuration, the rigid portion for increasing the rigidity of the core plate is provided. The rigid portion is provided so as to overlap with a single or plural insertion holes formed at a position adjacent to the boundary portion. That is, the rigid portion is provided so as to overlap with the joint portion between the tube and the core plate where a distortion is most likely to occur due to thermal expansion of the tube. The rigidity of the joint portion is enhanced by the rigid portion. As a result, the distortion generated in the core plate can be suppressed by the rigid portion.

According to the present disclosure, there is provided a heat exchanger capable of suppressing the distortion generated in the core plate.

Hereinafter, embodiments will be described with reference to the attached drawings. In order to facilitate the ease of understanding, the same reference numerals are attached to the same constituent elements in each drawing where possible, and redundant explanations are omitted.

A first embodiment is described below. A heat exchanger 10 according to the present embodiment is mounted on a vehicle (not shown) and is a radiator for cooling an internal combustion engine or the like of the vehicle. The heat exchanger 10 is supplied with a fluid whose temperature has risen through the internal combustion engine and a fluid whose temperature has risen through the electric motor or power converter mounted on the vehicle. In the heat exchanger 10, each of the fluids is cooled by heat exchange with air to lower the temperature. As described above, the heat exchanger 10 is configured to exchange heat between the fluid and the air. The fluid is cooling water made of LLC in this embodiment, but other fluids may be used.

As shown in FIG. 1, the heat exchanger 10 includes a tank 300, a tank 600, a tube 700, and a fin 800.

The tank 300 is a container for receiving cooling water supplied from the outside. The tank 300 is arranged in the upper portion of the heat exchanger 10. The tank 300 has a core plate 100 and a tank member 200. The core plate 100 is a plate-shaped member made of metal. The tube 700, which will be described later, is connected to the core plate 100. The specific shape of the core plate 100 will be described later.

Figure 2:
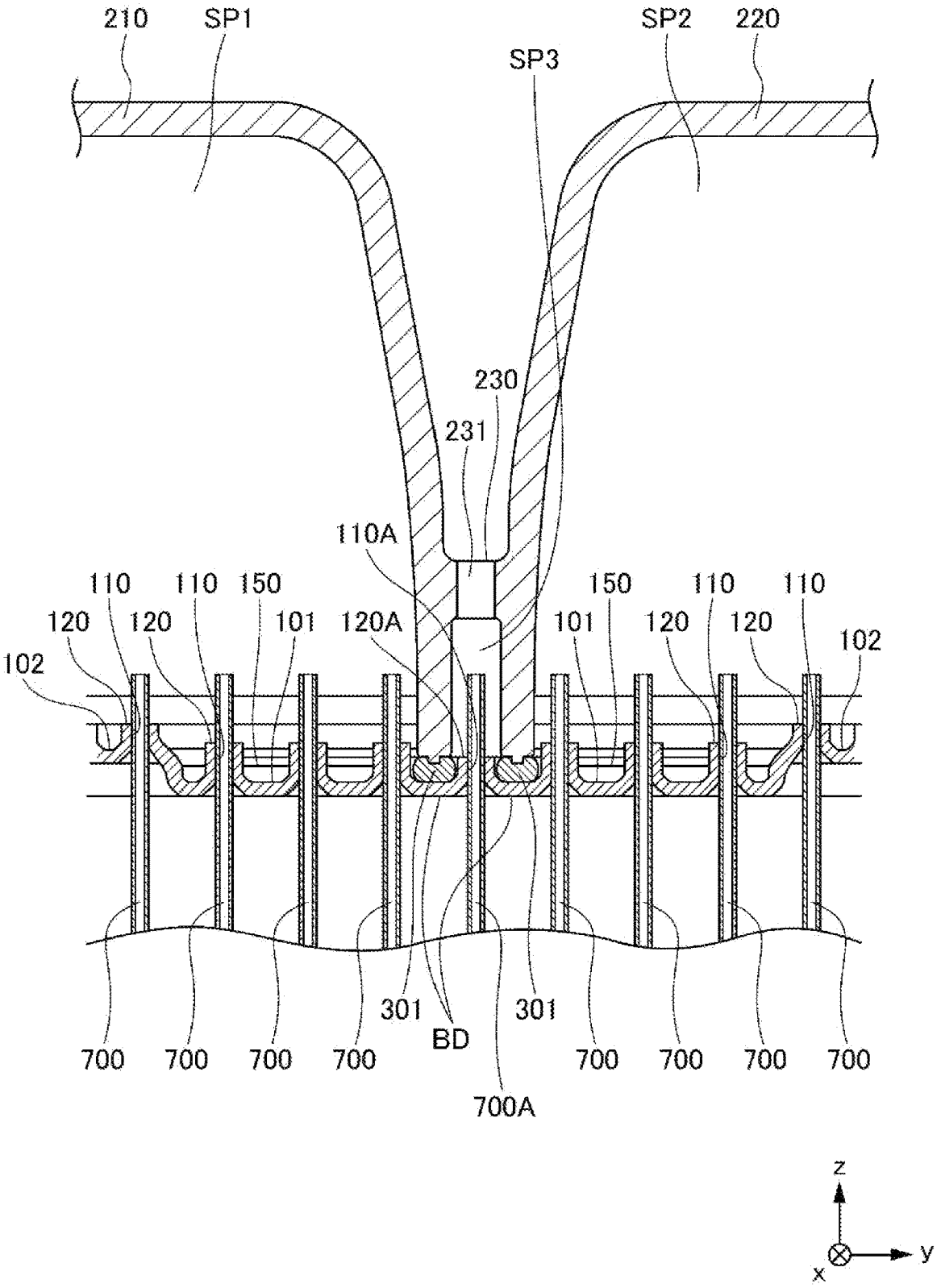
FIG. 2 is a diagram showing an internal structure of an area A in FIG. 1.

The tank member 200 includes a space for storing cooling water, and is made of resin in the present embodiment. The tank member 200 is open at the lower portion, and the core plate 100 is provided so as to cover the open portion. The core plate 100 is fixed to the tank member 200 by crimping with a seal member 301 interposed between the core plate 100 and the tank member 200. Only a part of the seal member 301 is shown in FIG. 2.

The tank 600 is a container for receiving the cooling water that has passed through the tube 700 and discharging the cooling water to the outside. The tank 600 is arranged in the lower portion of the heat exchanger 10. The shape of the tank 600 is substantially symmetrical with respect to the shape of the tank 300 in the vertical direction. The tank 600 has a core plate 400 and a tank member 500. The core plate 400 is a plate-shaped member made of metal. The tube 700 is connected to the core plate 400.

The tank member 500 includes a space for storing cooling water, and is made of resin in the present embodiment. The tank member 200 is open at the upper portion, and the core plate 400 is provided so as to cover the open portion. The core plate 400 is fixed to the tank member 500 by crimping with a seal member (not shown) interposed between the core plate 400 and the tank member 500.

The tube 700 is a tubular member through which cooling water flows. The tubes 700 are stacked in the left-right direction in FIG. 1. The direction in which the tubes 700 are lined up is also referred to as a "stacking direction" below.

Each of the tubes 700 is arranged so that its longitudinal direction is along the vertical direction. The upper end of the tube 700 is connected to the core plate 100, and the lower end of the tube 700 is connected to the core plate 400. The internal space of the tank 300 and the internal space of the tank 600 are communicated with each other by each of the tubes 700. The cooling water supplied to the tank 300 reaches the tank 600 through the inside of each of the tubes 700. At that time, heat exchange is performed between high-temperature cooling water passing inside of the tube 700 and low-temperature air passing through outside of the tube 700, such that the cooling water is lowered in temperature.

The fin 800 is a corrugated fin formed by bending a metal plate. The fin 800 is arranged so as to cover the entire space between the tubes 700, but only a part thereof is shown in FIG. 1. The fin 800 is brazed to the tube 700 on the left and right sides. The fin 800 increases the contact area with air, and the efficiency of heat exchange between the cooling water and air is improved.

In FIG. 1, the air passes through the heat exchanger 10 in the x direction from the front side to the back side of the paper surface, and an x axis is set along the x direction. The tubes 700 are lined up in the y direction from the left side to the right side, and a y axis is set along the y direction. The y direction is equal to the stacking direction. Further, in FIG. 1, the longitudinal direction of the tube 700 from the lower side to the upper side is the z direction, and a z axis is set along the z direction. In the following, the description will be given using the x-direction, the y-direction, and the z-direction defined as described above.

In the heat exchanger 10, the tubes 700 and the fins 800 are stacked with each other where heat exchange is performed between the cooling water and air, which is referred to as a so-called "heat exchange core portion". Both sides of the heat exchange core portion in the stacking direction are sandwiched by side plates 910, 920. The side plate 910, 920 is plate-shaped member made of metal, and provided for reinforcing the heat exchange core portion.

The side plate 910 is provided at one side (−y side) of the heat exchange core portion in the y direction. The upper end of the side plate 910 is connected to the core plate 100, and the lower end of the side plate 910 is connected to the core plate 400. The side plate 920 is provided at the other side (+y side) of the heat exchange core portion in the y direction. The upper end of the side plate 920 is connected to the core plate 100, and the lower end of the side plate 920 is connected to the core plate 400. The fin 800 is also provided at a position between the side plate 910 and the tube 700 and a position between the side plate 920 and the tube 700.

A specific configuration of the tank member 200 will be described with reference to FIGS. 1 and 2. The tank member 200 has a first portion 210, a second portion 220, and a third portion 230. The first portion 210 extends from one end of the tank member 200 toward the other end to a position over the center in the y direction. The second portion 220 extends from the other end of the tank member 200 in the y direction toward the first portion 210. The third portion 230 is provided at a position between the first portion 210 and the second portion 220.

As shown in FIG. 2, the first space SP1 is formed inside the first portion 210, the second space SP2 is formed inside the second portion 220, and the third space SP3 is formed inside the third portion 230. The three spaces are separated from each other, and are formed so as to be arranged in the y direction, that is, in the stacking direction.

Both the first space SP1 and the second space SP2 store the cooling water inside. The third space SP3 is connected to outside through the opening 231, and the cooling water is not supplied to the third space SP3. As shown in FIG. 2, one tube 700A is connected to the third space SP3. The tube 700A has the same shape as the other tubes 700, but is provided as a "dummy tube" in which the cooling water does not flow. The tube 700A will be referred to as "dummy tube 700A" below.

The tank member 500 has the first portion 510, the second portion 520, and the third portion 530 similarly as described above. The first portion 510 is provided at a position corresponding to the first portion 210 in the −z direction. The second portion 520 is provided at a position corresponding to the second portion 220 in the −z direction. The third portion 530 is provided at a position corresponding to the third portion 230 in the −z direction.

The first portion 210 has a first supply port 211. The first supply port 211 receives the cooling water after passing through the internal combustion engine. The cooling water supplied to the first supply port 211 passes through the inside of the tubes 700 connected to the first space SP1 and then is supplied to the first portion 510 of the tank 600. The first portion 510 has a first discharge port 511. The first discharge port 511 discharges the cooling water from the first portion 510 to outside. The cooling water discharged from the first discharge port 511 is supplied to the internal combustion engine again and is used for cooling the internal combustion engine.

The second portion 220 has a second supply port 221. The second supply port 221 receives the cooling water after passing through an electric motor or a power converter. The cooling water supplied to the second supply port 221 passes through the inside of the tubes 700 connected to the second space SP2, and then is supplied to the second portion 520 of the tank 600. The second portion 520 has a second discharge port 521. The second discharge port 521 discharges the cooling water from the second portion 520 to outside. The cooling water discharged from the second discharge port 521 is supplied to the electric motor or the power converter again to be used for cooling the electric motor or the power converter.

In this way, in the tank 300 of the heat exchanger 10, the first space SP1 and the second space SP2, for storing cooling water, are separated from each other and arranged in the stacking direction. The temperature of the cooling water supplied to the first space SP1 is higher than the temperature of the cooling water supplied to the second space SP2. The same applies to the tank 600.

The configuration of the core plate 100 will be described with reference mainly to FIGS. 3 to 9. The shape of the core plate 400 of the tank 600 is symmetrical with that of the core plate 100 in the vertical direction. Therefore, in the following, only the configuration of the core plate 100 will be described, and the description of the core plate 400 will be omitted.

Figure 3:
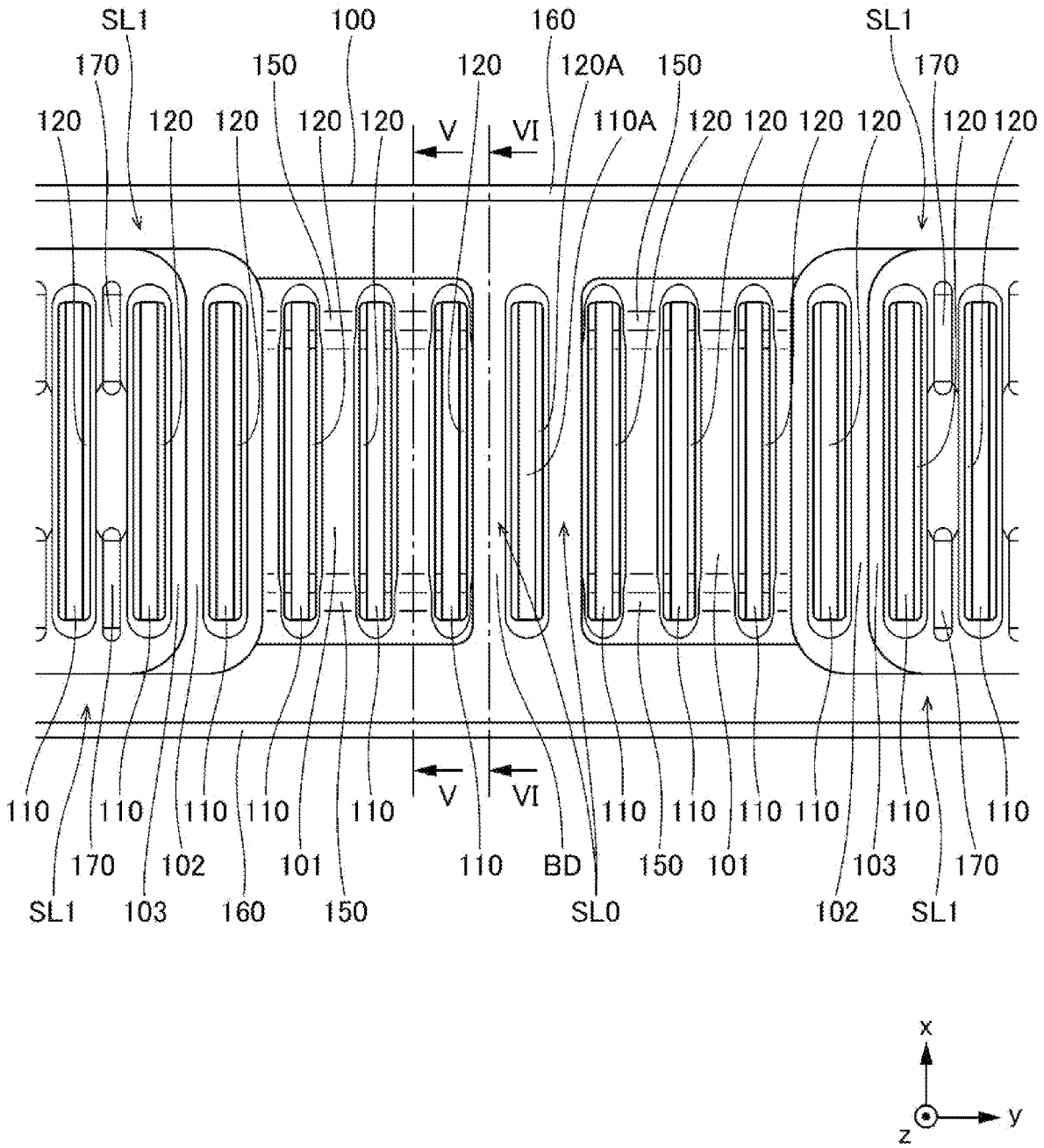
FIG. 3 is a diagram showing a core plate of the heat exchanger in FIG. 1.
Figure 4:
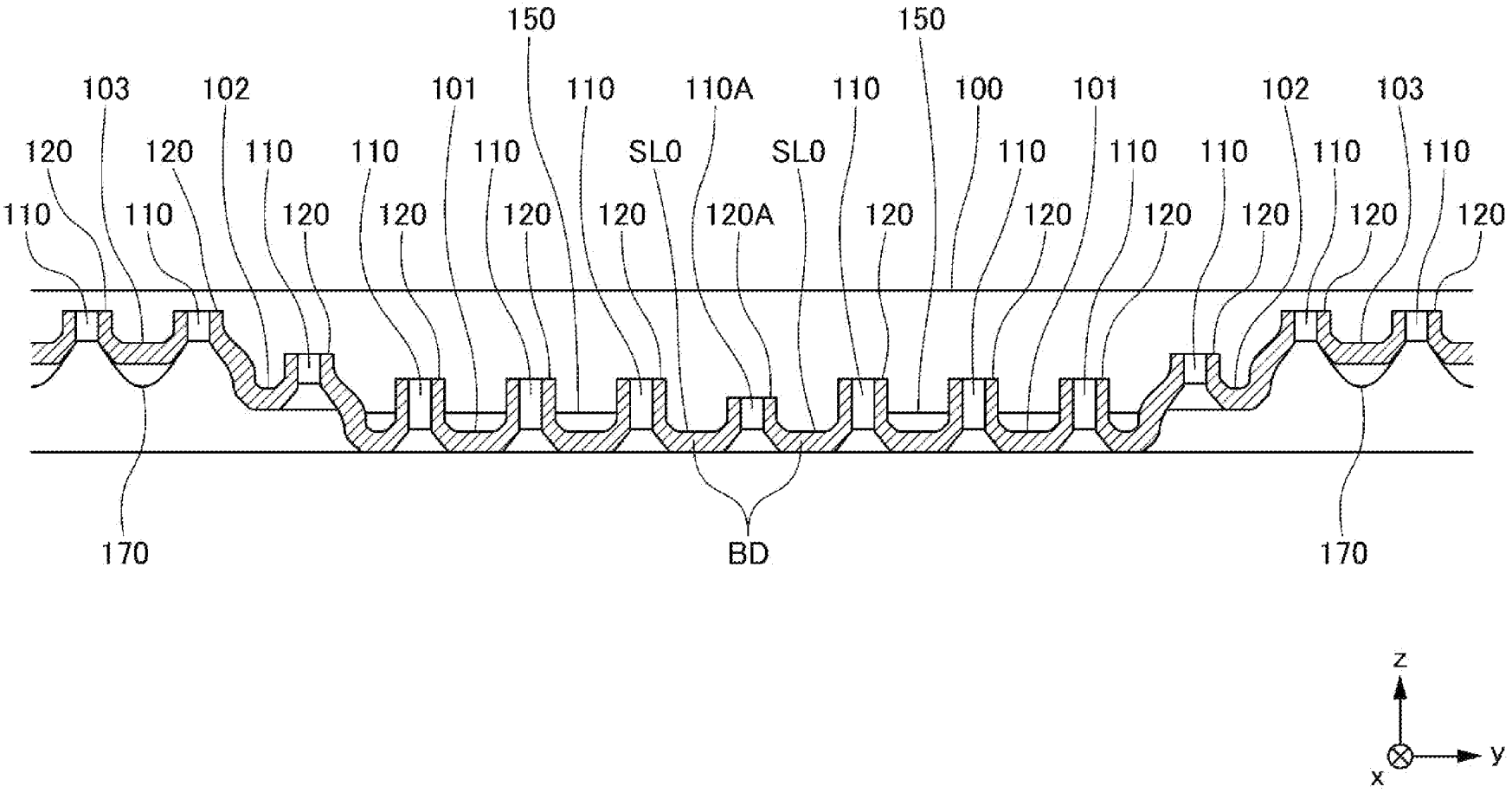
FIG. 4 is a diagram showing a core plate of the heat exchanger in FIG. 1.
Figure 5:
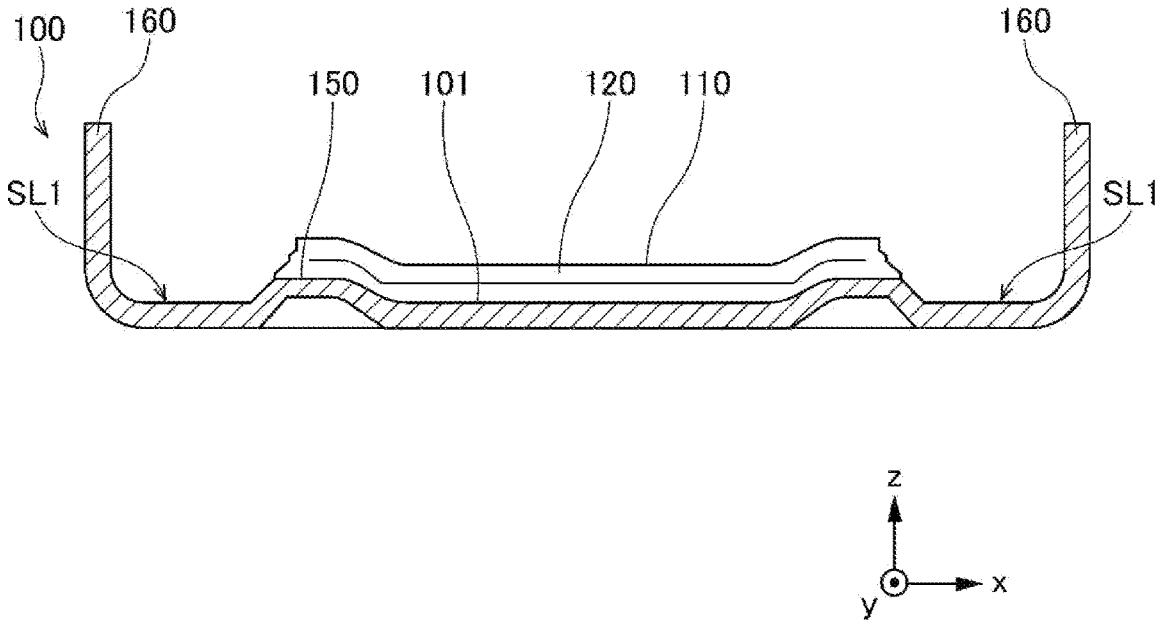
FIG. 5 is a cross sectional view taken along a line V-V in FIG. 3.
Figure 6:
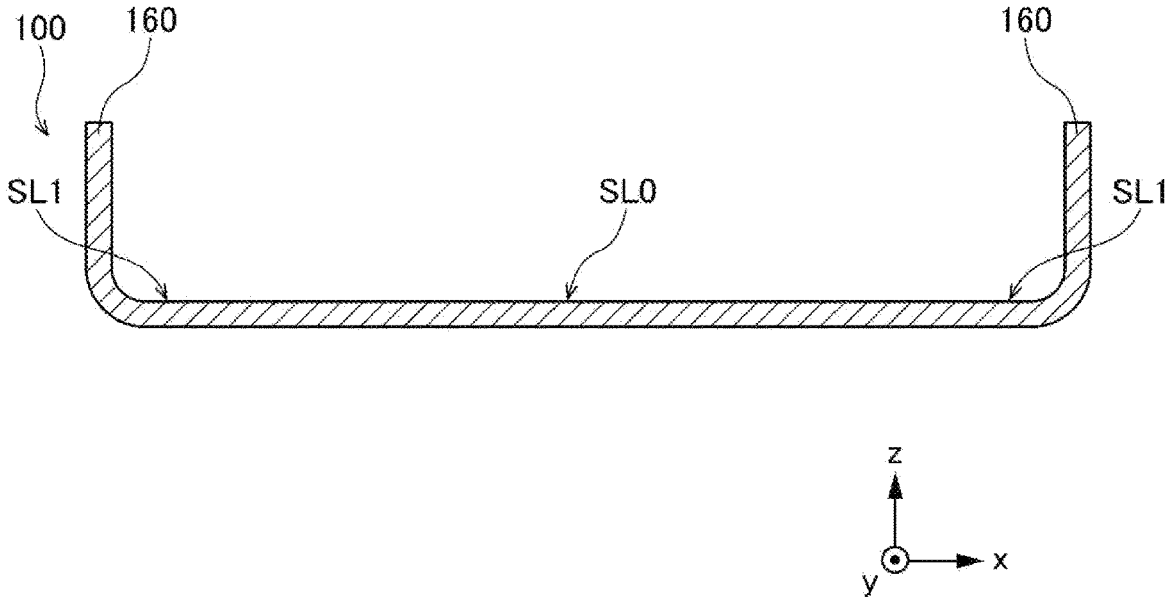
FIG. 6 is a cross sectional view taken along a line VI-VI in FIG. 3.
Figure 7:
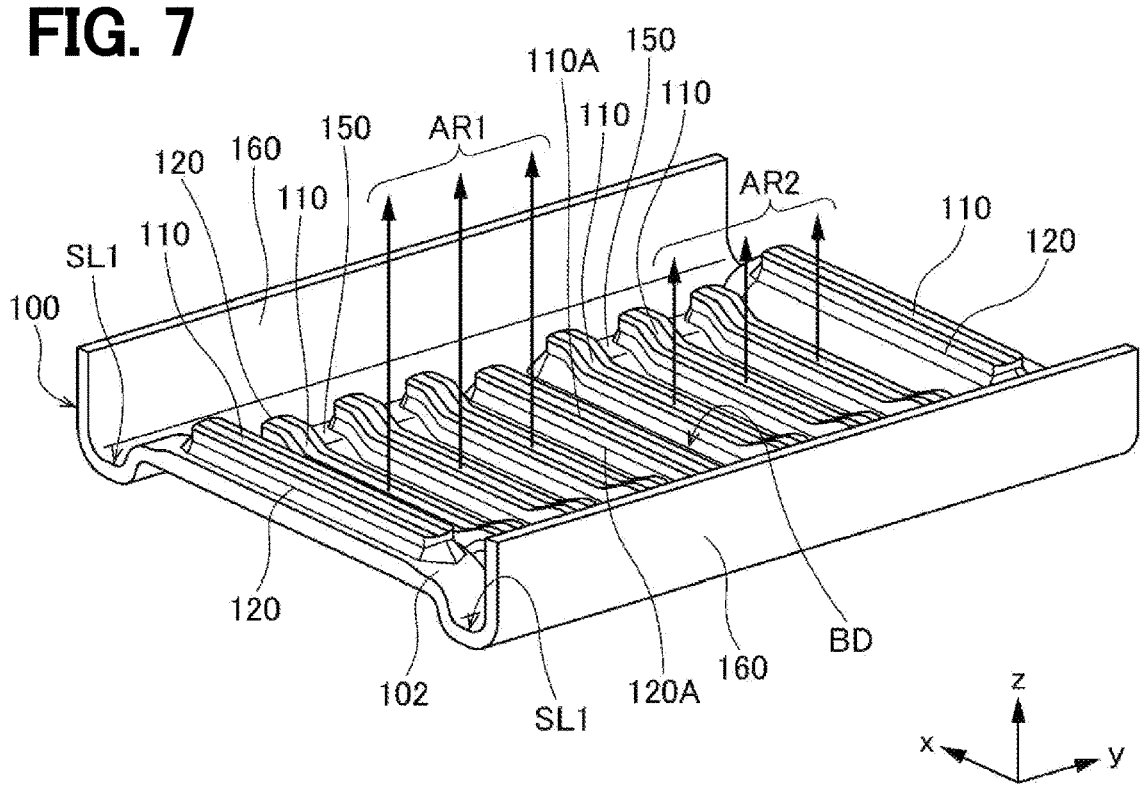
FIG. 7 is a perspective view showing a core plate of the heat exchanger in FIG. 1.
Figure 8:
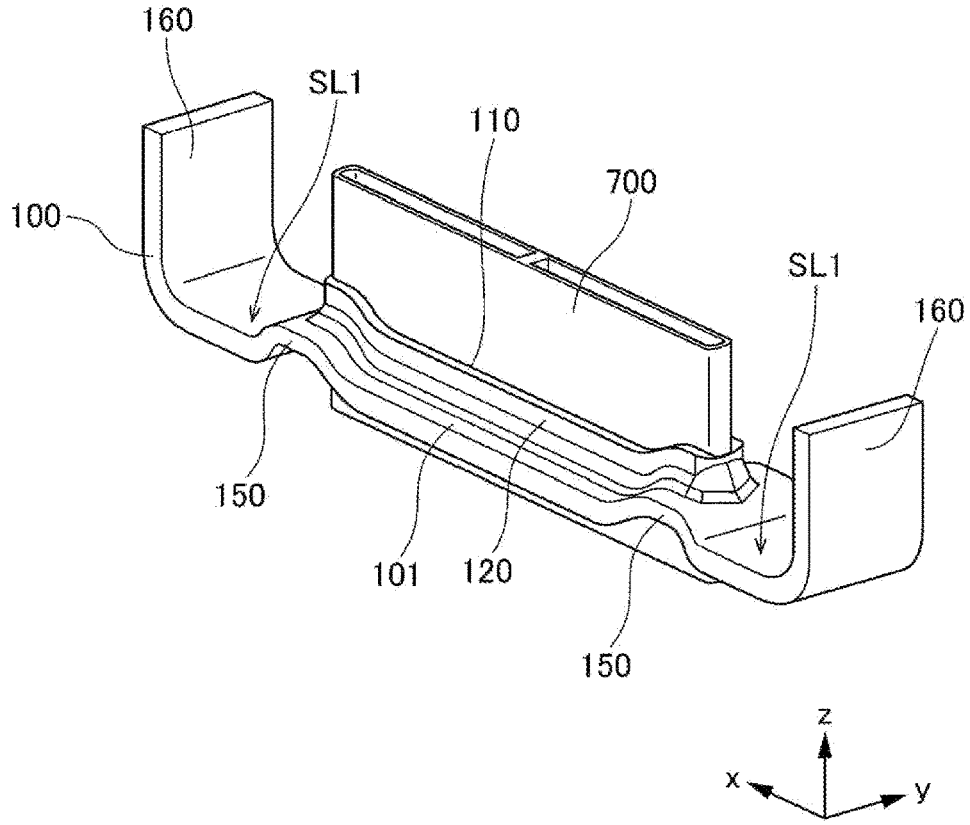
FIG. 8 is a perspective view showing a tube inserted in the core plate of the heat exchanger in FIG. 1.

FIG. 3 is a view illustrating a portion of the core plate 100 to which the tube 700A is connected and the vicinity thereof, as viewed from the z direction. FIG. 4 is a diagram schematically showing a cross section taken along the y-z plane. FIG. 5 is a cross section taken along a line V-V of FIG. 3. FIG. 6 is a cross section taken along a line VI-VI of FIG. 3. FIG. 7 is a perspective view illustrating the core plate 100 of FIG. 2. FIG. 8 is a perspective view illustrating the core plate 100 and one tube 700 connected to the core plate 100.

As shown in FIG. 5, the core plate 100 has an extending portion 160 extended from the peripheral end of the core plate 100 in the z direction. When viewed from the z-direction, as shown in FIG. 3, the extending portion 160 is formed along the entire outer periphery of the core plate 100. The extending portion 160 is fixed to the tank member 200 by crimping with the tank member 200 housed inside the extending portion 160.

The surface of the core plate 100 in the z-direction has a sealing surface SL1 to be in contact with the seal member 301 along the vicinity of the extending portion 160. The seal member 301 is a substantially annular member arranged along the extending portion 160, and is formed of, for example, rubber. The seal member 301 water-tightly seals the gap between the core plate 100 and the tank member 200.

The insertion holes 110 are formed in the core plate 100. The insertion holes 110 are through holes through which the respective tubes 700 are inserted, and are arranged in the stacking direction. As shown in FIGS. 4 and 7, the core plate 100 has a protrusion 120 corresponding to each of the tubes 700. The protrusion 120 protrudes from the core plate 100 in the z-direction. The insertion hole 110 passes through the tip of the protrusion 120 along the z direction. The tube 700 inserted through the insertion hole 110 is brazed to the inner surface of the protrusion 120 and is supported by the protrusion 120.

In FIG. 3, the tube 700A is inserted into an insertion hole 110A of the insertion holes 110. Similarly, in FIG. 3, a protrusion 120A of the protrusions 120 has the insertion hole 110A.

As shown in FIGS. 3 and 6, a part of the surface of the core plate 100 in the z-direction around the protrusion 120A is a sealing surface SL0 having the same height as the sealing surface SL1. The seal member 301 has a portion extending linearly along the x direction from a middle of the annular portion arranged along the extending portion 160. As a result, the inflow of cooling water into the third space SP3 and the tube 700A is restricted. The sealing surface SL0 is in contact with the seal member 301 extending linearly along the x direction.

The core plate 100 has a boundary portion BD, at which the sealing surface SL0 and the protrusion 120A are formed. The boundary portion BD faces the third space SP3 and corresponds to a boundary between the first space SP1 and the second space SP2.

The core plate 100 has a first plane portion 101 on the inner side of the sealing surface SL1. As shown in FIGS. 3 and 4, the first plane portion 101 has the same height as the sealing surface SL1 and the sealing surface SL0. The first plane portion 101 is formed on both sides of the boundary portion BD in the y direction, and has three protrusions 120.

The core plate 100 has a second plane portion 102 on the inner side of the sealing surface SL1. As shown in FIGS. 3 and 4, the second plane portion 102 is located on the upper side of the first plane portion 101 in the z direction. A single protrusion 120 is formed on each of the second plane portions 102.

The core plate 100 has a third plane portion 103 on the inner side of the sealing surface SL1. As shown in FIGS. 3 and 4, the third plane portion 103 is located on the upper side of the second plane portion 102 in the z direction. All the remaining protrusions 120 are formed on each of the third plane portions 103. Ribs 170 are formed on the third plane portion 103. The rib 170 is formed by deforming a portion of the third plane portion 103 between the protrusions 120 adjacent to each other so as to protrude in the −z direction. The rib 170 raises the overall rigidity of the core plate 100.

The core plate 100 can be formed by, for example, pressing a metal plate a plurality of times.

As described above, high-temperature cooling water flows in the first space SP1 and the tube 700 connected to the first space SP1, after passing through the internal combustion engine. Therefore, the size of the tube 700 expands in the z direction due to the thermal expansion. The amount of expansion is relatively large. In FIG. 7, the amount of expansion of the tube 700 due to thermal expansion is indicated by the arrow AR1.

On the other hand, low-temperature cooling water flows in the second space SP2 and the tube 700 connected to the second space SP2, after passing through the electric motor or the like. Therefore, the size of the tube 700 expands in the z direction due to thermal expansion, but the amount of expansion is relatively small. In FIG. 7, the amount of expansion of the tube 700 due to thermal expansion is indicated by the arrow AR2.

In the vicinity of the boundary portion BD, the core plate receiving a force from the tube 700 along the arrow AR1 is largely displaced in the z direction, at one side of the boundary portion BD in the −y direction. On the other hand, the core plate receiving a force along the arrow AR2 from the tube 700 is displaced slightly in the z-direction, at the other side of the boundary portion BD in the y-direction. Therefore, in the boundary portion BD and its vicinity of the core plate 100, a large strain (distortion) tends to occur due to thermal expansion of the tube 700. As a result, a part of the tube 700 joined to the boundary portion BD may be damaged and the cooling water may leak outside.

The heat exchanger 10 according to the present embodiment suppresses the strain generated in the core plate 100 by devising the shape of the core plate 100.

As shown in FIGS. 3, 5, 7, and 8, a rigid portion 150 is formed on the core plate 100 according to the present embodiment. Due to the rigid portion 150, the core plate 100 has a concave shape recessed in the z-direction, that is, toward the inside of the tank 300. The rigid portion 150 is formed so as to extend linearly along the y direction. As shown in FIG. 3 viewed in the z-direction, the rigid portion 150 overlaps with the three insertion holes 110 formed in the first plane portion 101. The rigidity of the core plate 100 against bending is increased by the rigid portion 150. Therefore, even if the force is applied to the core plate 100 from each tube 700 in the direction indicated by the arrows AR1 and AR2 in FIG. 7, the strain generated in the core plate 100 is smaller, compared with a conventional case in which the rigid portion 150 is not formed.

As described above, in the present embodiment, the rigid portion 150 for increasing the rigidity of the core plate 100 is provided so as to overlap with the insertion holes 110 formed at the position adjacent to the boundary portion BD. The insertion holes 110 adjacent to the boundary portion BD includes a closest insertion hole 110 the closest to the boundary portion BD, in either the first space SP1 or the second space SP2. The greater the number of insertion holes 110 that overlap with the rigid portion 150, the smaller the distortion that occurs in the core plate 100.

The rigid portion 150 is provided in each of a portion of the core plate 100 facing the first space SP1 and a portion of the core plate 100 facing the second space SP2. That is, the rigid portion 150 is provided at position on both sides of the boundary portion BD. Since the rigid portion 150 is provided so as to cover the entire portion of the core plate 100 where distortion is likely to occur, it is possible to further suppress the distortion generated in the core plate 100, compared with a case where the rigid portion 150 is provided only on one side of the boundary portion BD.

Further, in the present embodiment, the number of insertion holes 110 overlapping the rigid portion 150 on the first space SP1 and the number of insertion holes 110 overlapping the rigid portion 150 on the second space SP2 are equal to each other. As a result, the strain is suppressed evenly by the rigid portion 150 on both sides of the boundary portion BD in the −y direction and the y direction in well-balanced manner, so that the strain generated in the core plate 100 is further suppressed.

If the magnitude of the strain generated on the first space SP1 and the magnitude of the strain generated on the second space SP2 are extremely different, the number of insertion holes 110 overlapping the rigid portion 150 on the first space SP1 and the number of insertion holes 110 overlapping the rigid portion 150 on the second space SP2 may be different from each other.

As described above, the dummy tube 700A in which fluid does not flow is connected to the boundary portion BD. The rigid portion 150 is provided on the core plate 100 at a position that does not overlap with the insertion hole 110A into which the dummy tube 700A is inserted. The insertion hole 110A corresponds to a dummy insertion hole in the present embodiment.

The flat sealing surface SL0 can be formed to be in contact with the seal member 301, by providing the rigid portion 150 at the position as described above, at the boundary portion BD between the insertion hole 110 and the insertion hole 110A.

In the present embodiment, two rigid portions 150 are formed in one first plane portion 101, and arranged in the x direction. Each of the rigid portions 150 is provided to extend along the y direction so as to overlap the end portion of the insertion hole 110 in the x direction which is a width direction perpendicular to both the longitudinal direction and the stacking direction of the tubes 700.

The end portion of the insertion hole 110 in the width direction is easily affected by the thermal expansion of the tube 700, and the largest distortion is likely to occur at the end portion, in the vicinity of the insertion hole 110. In the present embodiment, since the rigid portion 150 is formed to overlap the position where distortion is likely to occur, it is possible to efficiently suppress the distortion.

Figure 9:
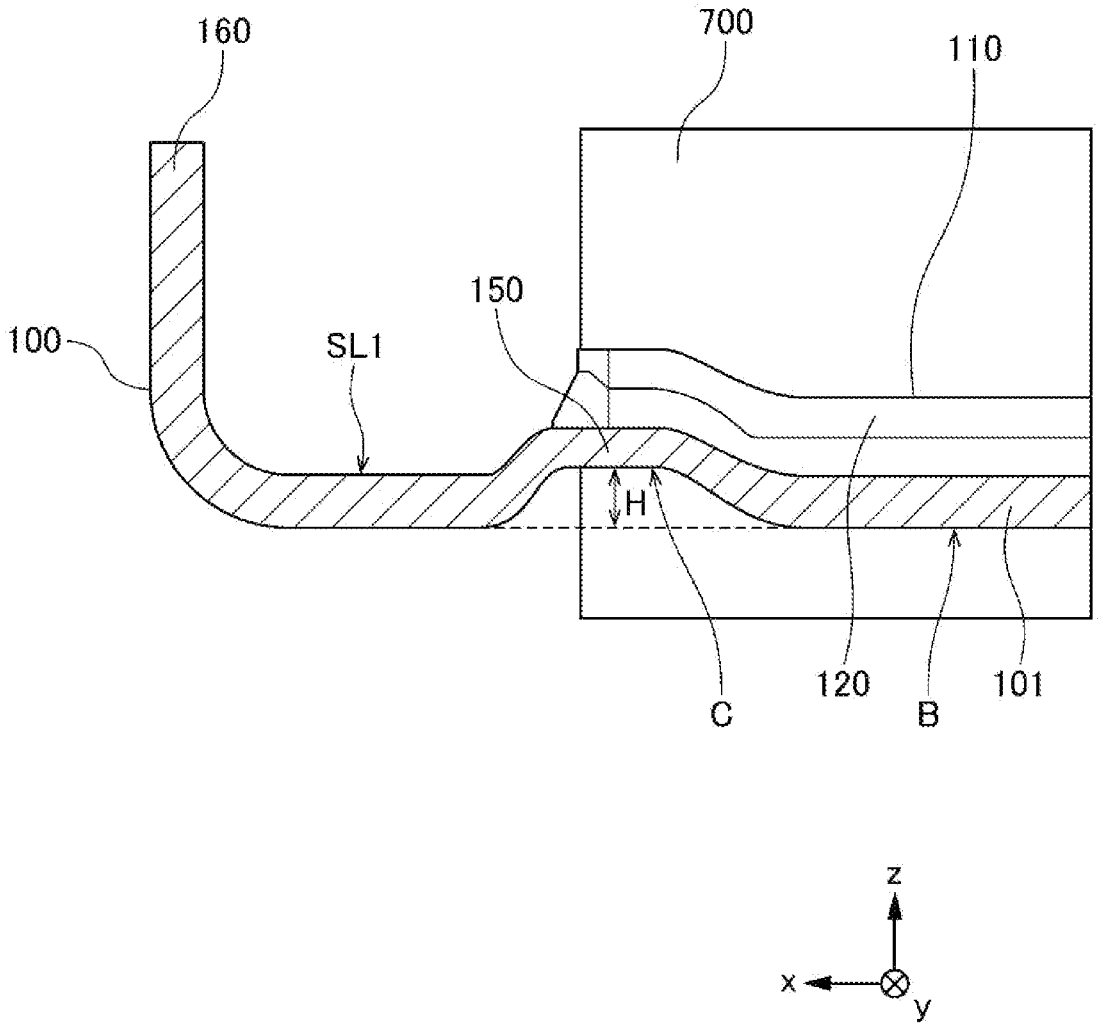
FIG. 9 is a diagram showing a rigid portion formed on a core plate.

FIG. 9 is a schematic cross-sectional view taken along an x-z plane to illustrate a portion of the core plate 100 in which the rigid portion 150 is formed, viewed from the −y direction. The position of the cross section is the same as the position of the cross section taken along a line V-V in FIG. 3. The tube 700 depicted in FIG. 9 is positioned the closest to the boundary portion BD, among the three tubes 700 connected to the first plane portion 101. The rigid portion 150 is not provided at a position further behind the paper surface than the tube 700, and the protrusion 120 is connected to the sealing surface SL0.

As described above, due to the rigid portion 150, the core plate 100 is recessed in the z-direction. FIG. 9 illustrates the recess dimension H in the z direction. In the present embodiment, the recess dimension H is set so that the height of the rigid portion 150 inside the tank 300 is lower than the height of the second plane portion 102 and the third plane portion 103.

Figure 10:
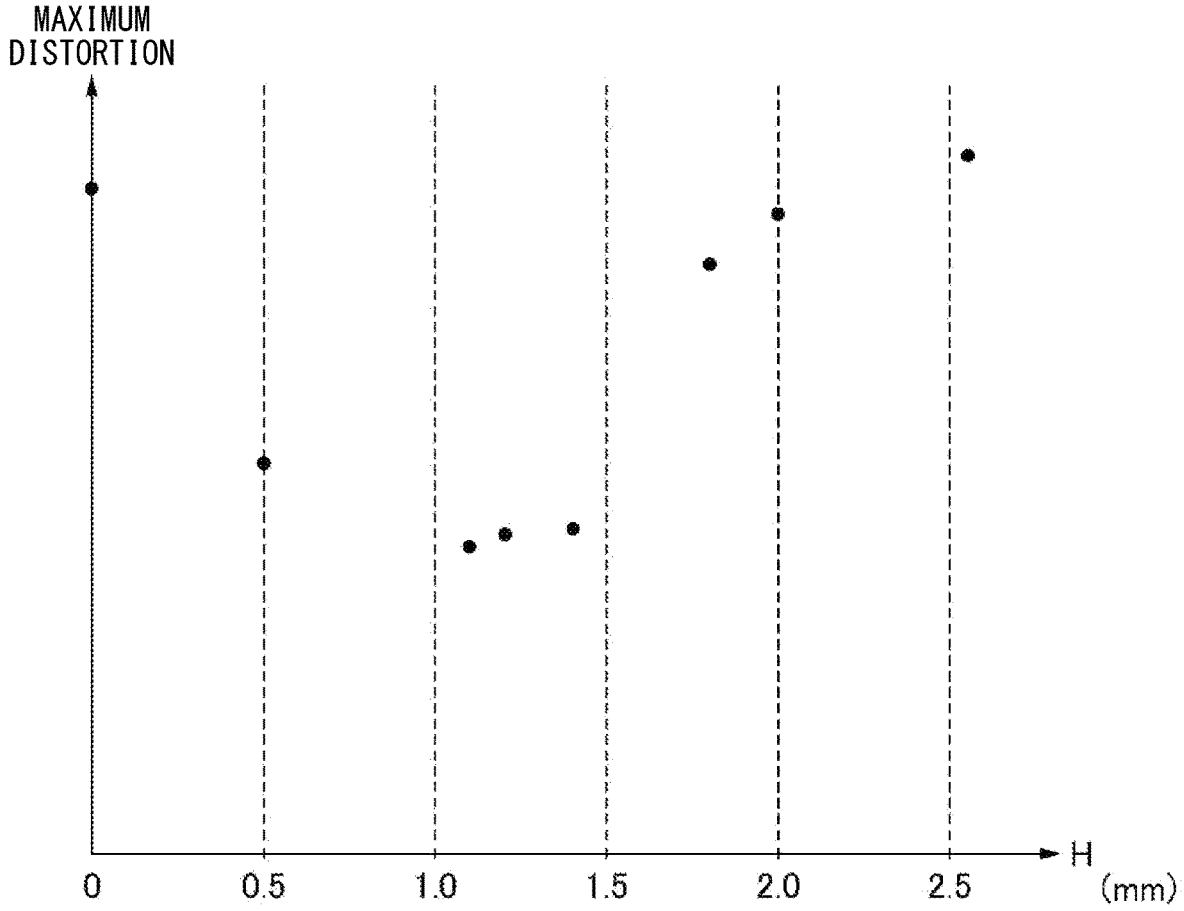
FIG. 10 is a graph showing a relationship between a shape of the rigid portion and the maximum value of distortion.

According to the confirmation by the present inventor through experiments and the like, the maximum value of the distortion generated in the core plate 100 changes according to the magnitude of the recess dimension H in FIG. 9. FIG. 10 shows the relationship between the amount of recess dimension H and the maximum value of distortion.

As shown in FIG. 10, the maximum value of the distortion decreases as the amount of recess dimension H increases from 0. When the recess dimension H is 0.5 or more, the maximum value of the distortion becomes a substantially constant value. After that, when the recess dimension H is further increased, the maximum value of the distortion tends to increase again. Specifically, when the recess dimension H exceeds 1.5 mm, the maximum value of distortion increases.

Figure 11:
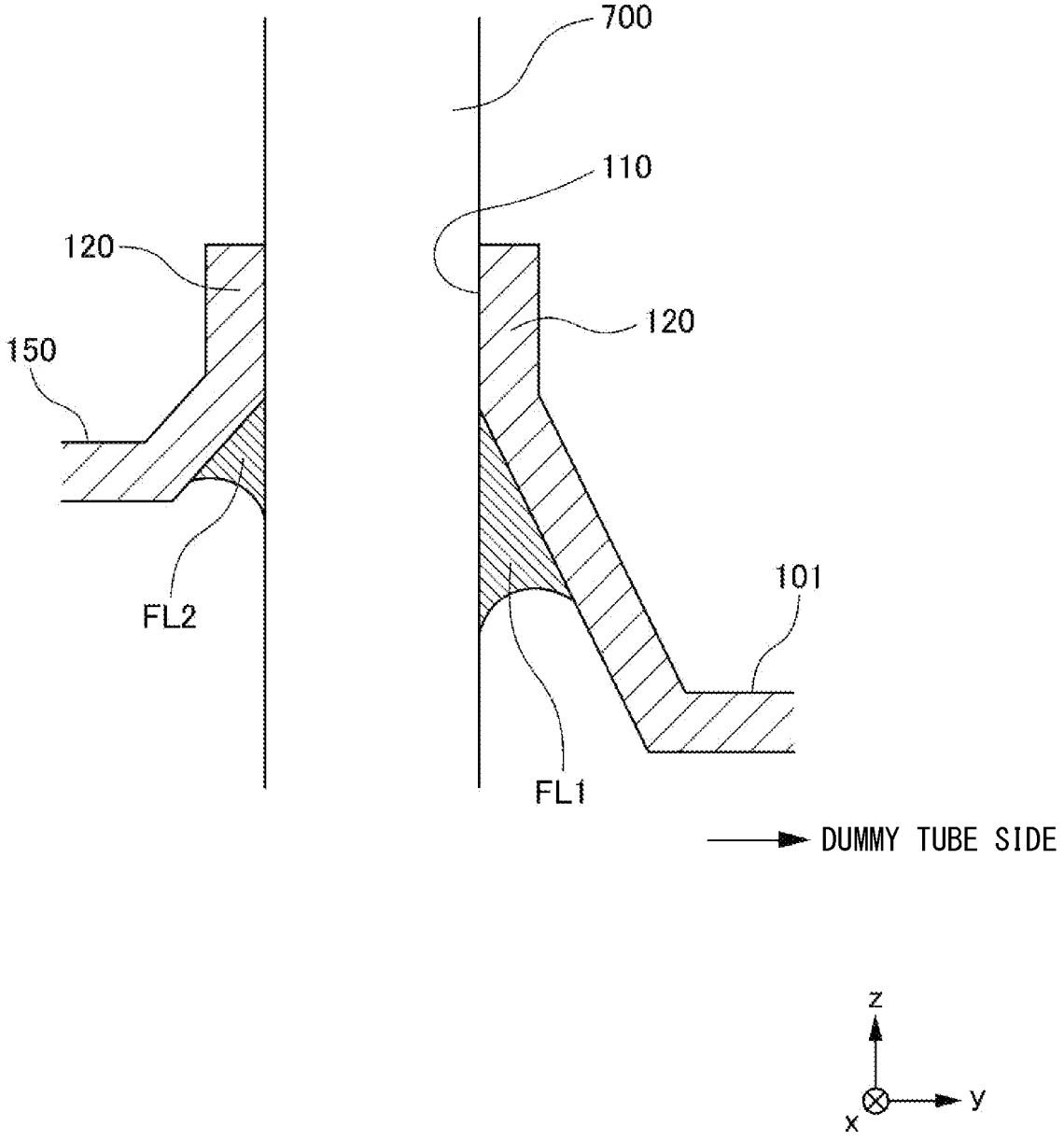
FIG. 11 is a diagram for explaining the relationship between the shape of the rigid portion and the maximum value of distortion.

The reason will be described with reference to FIG. 11. FIG. 11 shows a cross section of the core plate 100 taken along a y-z plane, where the tube 700 shown in FIG. 9 is connected. In FIG. 11, the rigid portion 150 is formed on one side of the tube 700 in the −y direction. Therefore, the height of the core plate 100 is higher than that of the other side of the tube 700 in the y-direction. As described above, the shape of the core plate 100 is asymmetrical between sides with respect to the tube 700, in the vicinity of the tube 700 arranged at the position the closest to the boundary portion BD.

In FIG. 11, brazing materials FL1 and FL2 for joining the tube 700 and the core plate 100 are shown. The brazing material FL1 joins the tube 700 to the core plate 100 in the y-direction. The brazing material FL2 joins the tube 700 to the core plate 100 in the −y direction. A fillet made of the brazing material is formed between the core plate 100 and the tube 700.

Since the shape of the core plates 100 is asymmetrical between both sides of the tube 700, the shape of the fillet made of the brazing material FL1 and the shape of the fillet made of the brazing material FL2 are different from each other in the cross section of FIG. 11. However, the brazing materials is one, as a whole, arranged so as to surround the tube 700. Therefore, the brazing material FL1 and the brazing material FL2 having different heights and shapes are connected to each other on the back side and the front side of the paper surface of FIG. 11. As a result, the shape of the brazing material is distorted at the connection of the brazing material, and stress concentration is likely to occur.

As the recess dimension H of the rigid portion 150 increases, the difference in shape between the brazing material FL1 and the brazing material FL2 increases, so that the stress concentration also increases. As a result, as shown in FIG. 10, when the recess dimension H exceeds 1.5 mm, the maximum value of the distortion becomes large. In view of the above, the recess dimension H is preferably within a range between 0.5 mm and 1.5 mm. Therefore, in the present embodiment, the rigid portion 150 that overlaps with the insertion hole 110 at the position the closest to the dummy tube 700A is formed within the range between 0.5 mm and 1.5 mm by making the core plate 100 recessed toward the inside of the tank 300. As a result, the distortion generated in the core plate 100 is surely suppressed.

The shape of the rigid portion 150 for suppressing the distortion of the core plate 100 may be different from that of the present embodiment. For example, the thickness of the core plate 100 may be increased at the position of the rigid portion 150. However, in that case, it is necessary to form the core plate 100 using a plate-shaped member that is partially thickened. As a result, the cost of parts increases. From the viewpoint of suppressing the cost, it is preferable to form the rigid portion 150 by bending the core plate 100 to recess in the z direction as in the present embodiment.

Another advantage of forming the rigid portion 150 by recessing the core plate 100 in the z direction as in the present embodiment will be described with reference to FIG. 9.

The thermally expanding tube 700 applies a force on the core plate 100 at the joint by brazing. In FIG. 9, the position of the joint of the tube 700 at the center in the width direction is indicated by B. Most of the force from the thermally expanding tube 700 acts on the core plate 100 in the z coordinate at the position B.

In the present embodiment, the rigid portion 150 is formed by recessing the core plate 100 in the z direction. Therefore, the position of the joint of the rigid portion 150 is indicated by C in FIG. 9. The position C is located on the upper side in the z-direction than the position B is.

That is, in the present embodiment, the position of the joint that receives the force from the tube 700 is farther away from the other portion B in the z direction, while the distortion due to thermal expansion is most likely to occur at the end portion of the insertion hole 110 in the width direction. This makes it possible to suppress the distortion caused by the force received from the tube 700 at the end portion of the insertion hole 110 in the width direction.

In the present embodiment, the position of the tip of the rigid portion 150 is lower than the position of the inner surface of the second plane portion 102 and the third plane portion 103, inside the tank 300. That is, the z-coordinate of the tip of the rigid portion 150 is smaller than the z-coordinate of the surface of the second plane portion 102 and the third plane portion 103 in the z-direction. The insertion hole 110 that does not overlap with the rigid portion 150 is formed in the second plane portion 102 and the third plane portion 103 of the core plate 100. In such a configuration, the core plate 100 can be easily formed by pressing a metal plate a plurality of times. The position of the inner surface of the second plane portion 102 and the third plane portion 103 represents a position of a flat surface of the second plane portion 102 excluding the protrusion 120 and the insertion hole 110. That is, the inner surface of the second plane portion 102 and the third plane portion 103 is a plane portion perpendicular to the z-axis.

Figure 12:
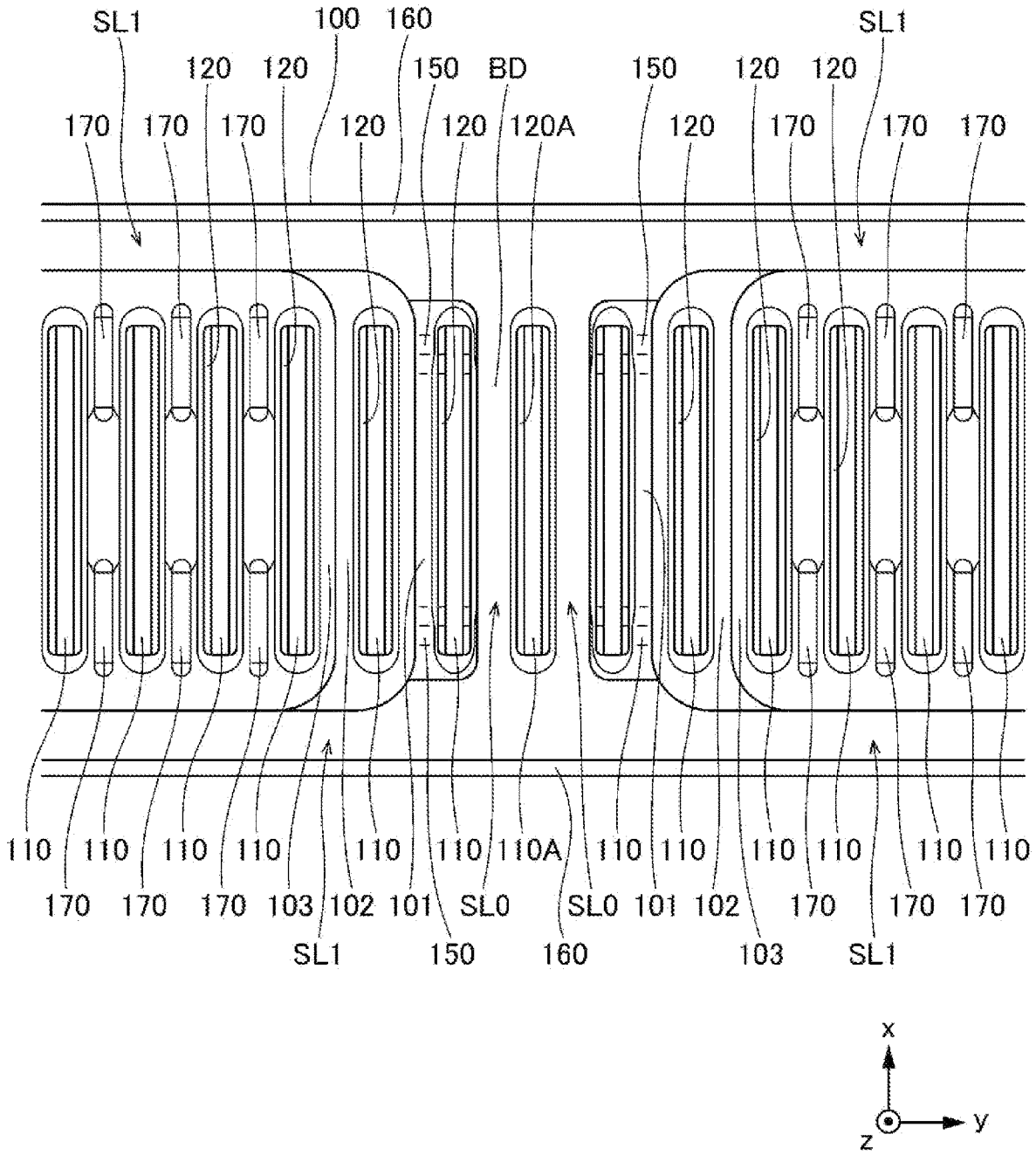
FIG. 12 is a diagram showing a core plate of a heat exchanger according to a second embodiment.

A second embodiment will be described with reference to FIG. 12. The present embodiment is different from the first embodiment only in the shape of the core plate 100, and is the same as the first embodiment in other respects. Hereinafter, only parts different from the first embodiment will be described, and description of parts common to the first embodiment will be omitted for brevity where appropriate.

In the present embodiment, the number of insertion holes 110 formed in the first plane portion 101 is only one. As a result, the rigid portion 150 is provided so as to overlap the single insertion hole 110 at the position the closest to the boundary portion BD. For example, when the temperature difference between the two cooling waters supplied to the heat exchanger 10 is small and the magnitude of the strain generated in the core plate 100 is small, the strain can be sufficiently suppressed even with such a configuration. As described above, the number of insertion holes 110 overlapping with the rigid portion 150 may be appropriately adjusted according to the temperature difference of the cooling water, the shape of the tube 700, and the like.

Figure 13:
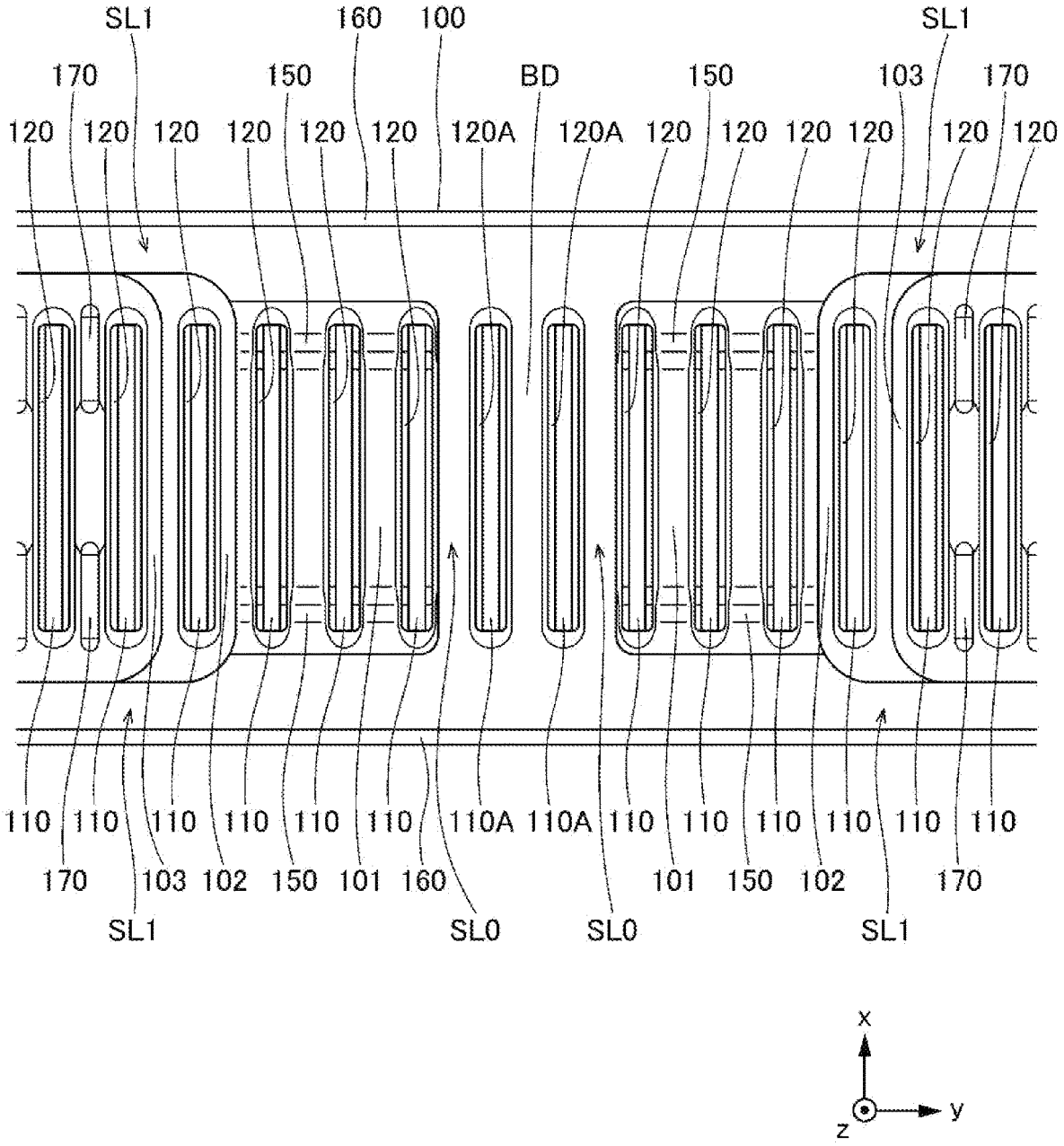
FIG. 13 is a diagram showing a core plate of a heat exchanger according to a third embodiment.

A third embodiment will be described with reference to FIG. 13. The present embodiment is different from the first embodiment only in the shape of the core plate 100, and is the same as the first embodiment in other respects. Hereinafter, only parts different from the first embodiment will be described, and description of parts common to the first embodiment will be omitted for brevity where appropriate.

In the present embodiment, two insertion holes 110A are formed and arranged in the y direction. A dummy tube 700A in which cooling water does not flow is inserted into and joined to each of the insertion holes 110A. For example, when the temperature difference between the two cooling waters supplied to the heat exchanger 10 is large and the amount of distortion generated in the core plate 100 is large, it is effective to secure a wide range of the boundary portion BD by increasing the number of dummy tubes 700A.

A fourth embodiment will be described with reference to FIGS. 14 and 15. The present embodiment is different from the first embodiment only in the shape of the core plate 100, and is the same as the first embodiment in other respects. Hereinafter, only parts different from the first embodiment will be described, and description of parts common to the first embodiment will be omitted for brevity where appropriate.

Figure 14:
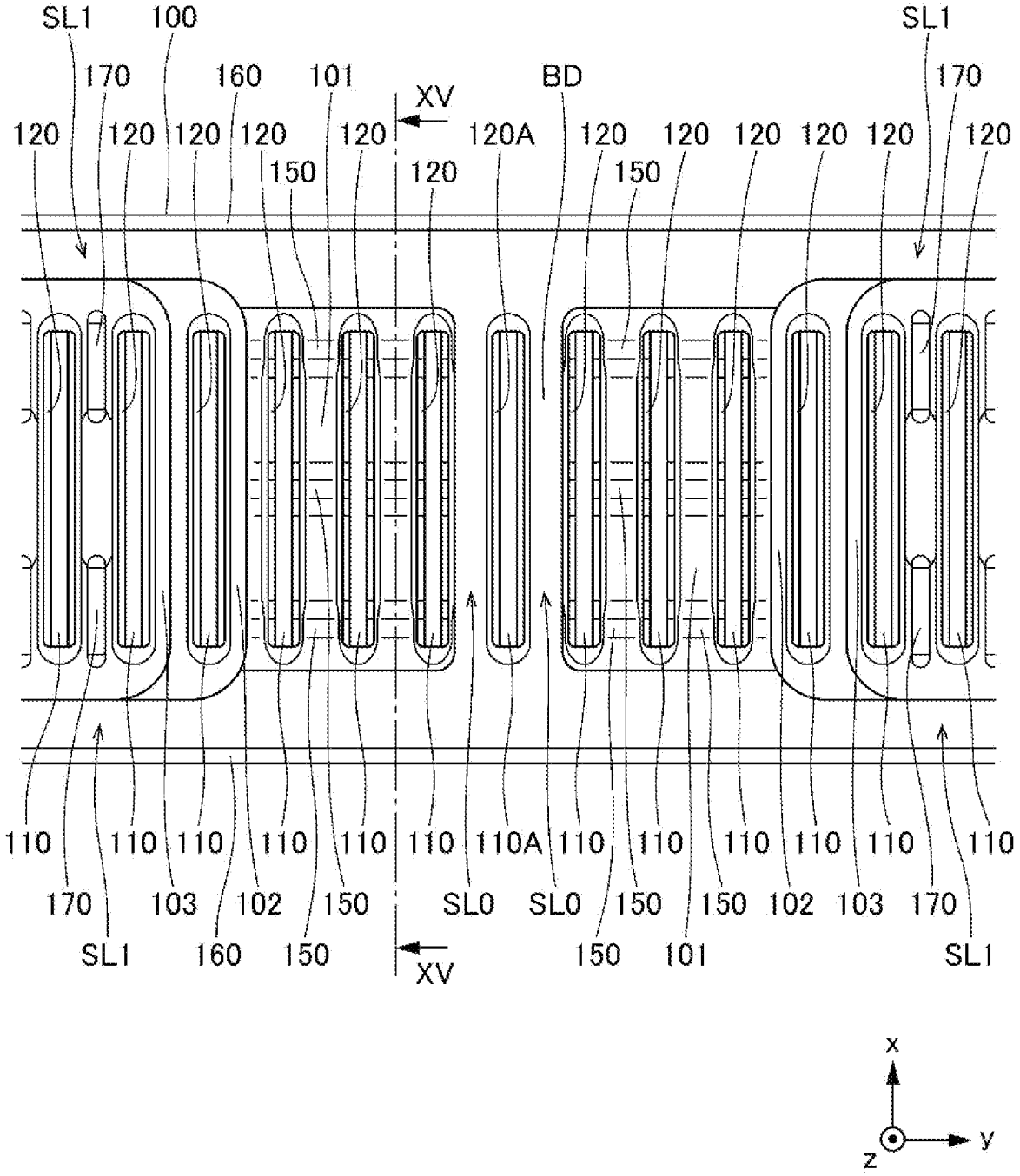
FIG. 14 is a diagram showing a core plate of a heat exchanger according to a fourth embodiment.
Figure 15:
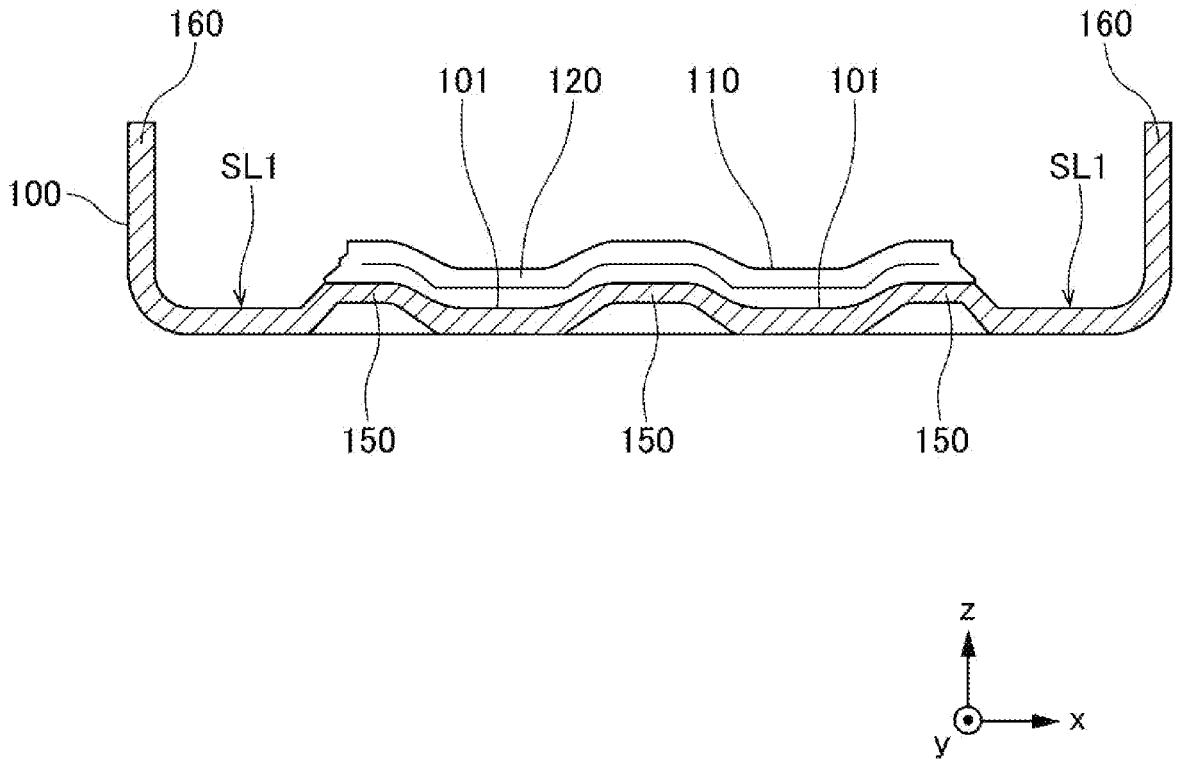
FIG. 15 is a cross sectional view taken along a line XV-XV in FIG. 14.

FIG. 14 illustrates the core plate 100 according to the fourth embodiment from the same viewpoint as in FIG. 3. FIG. 15 is a cross-section taken along a line XV-XV of FIG. 14.

In the present embodiment, three rigid portions 150 are formed in one first plane portion 101, and arranged in the x direction. Two rigid portions 150 arranged at the end portions in the x direction are the same as those in the first embodiment of FIG. 3, and overlap with the end portions of the insertion hole 110 in the width direction. In the present embodiment, the rigid portion 150 arranged at the central position in the x direction is added, and overlaps with the central portion of the insertion hole 110 in the width direction. The shapes of the three rigid portions 150 are the same as each other.

As described above, in the present embodiment, plural rigid portions 150 are provided on each of the first space SP1 and the second space SP2. Some of the rigid portions 150 are provided so as to overlap with the end portions of the insertion holes 110 in the width direction. The present embodiment enables to produce the same effects as those described in the first embodiment. The number of the rigid portions 150 provided so as to overlap the end portions of the insertion holes 110 in the width direction can be appropriately changed. However, it is preferable that at least one rigid portion 150 is provided so as to overlap the end portion of the insertion hole 110 in the width direction.

A fifth embodiment will be described with reference to FIGS. 16 and 17. The present embodiment is different from the first embodiment only in the shape of the core plate 100, and is the same as the first embodiment in other respects. Hereinafter, only parts different from the first embodiment will be described, and description of parts common to the first embodiment will be omitted for brevity where appropriate.

Figure 16:
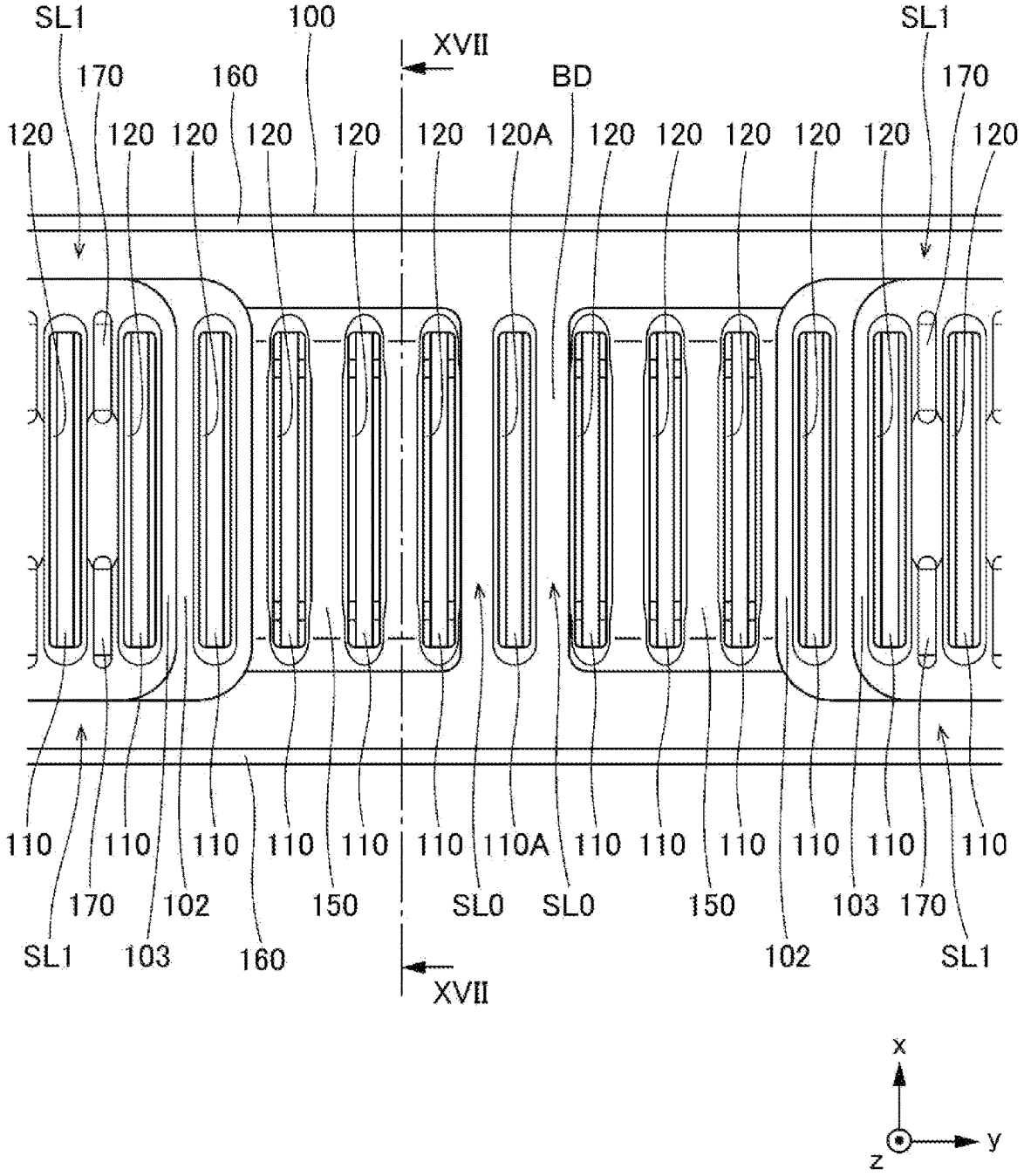
FIG. 16 is a diagram showing a core plate of a heat exchanger according to a fifth embodiment.
Figure 17:
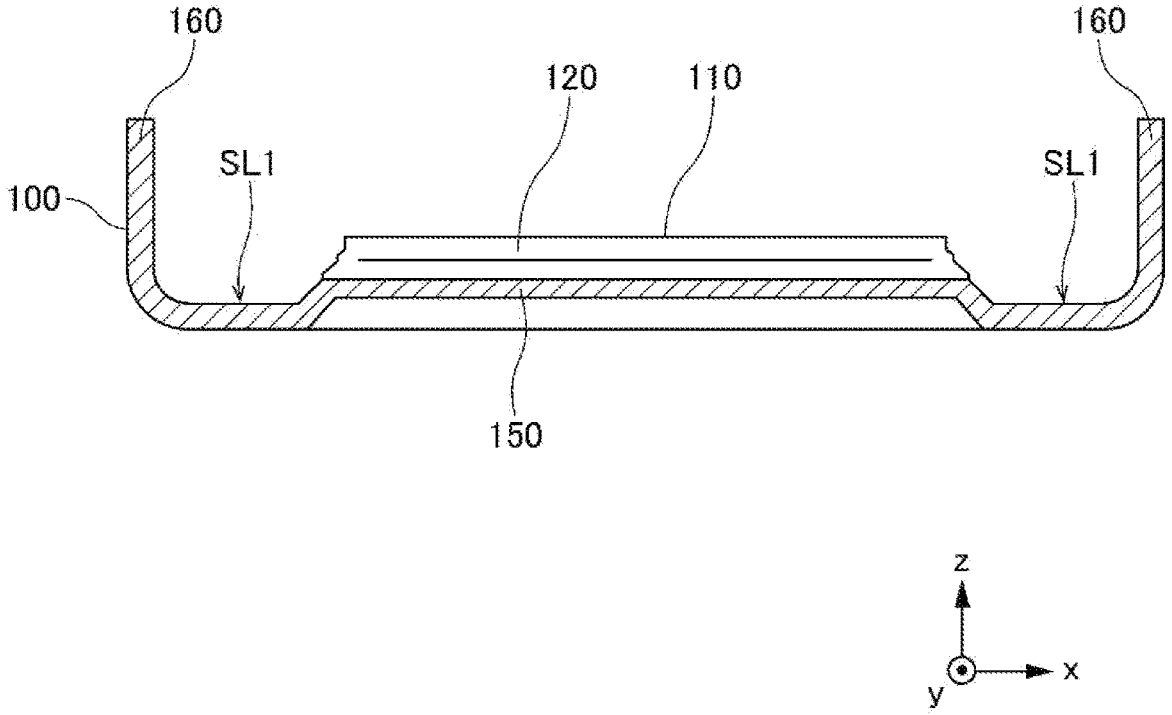
FIG. 17 is a cross sectional view taken along a line XVII-XVII in FIG. 16.

FIG. 16 illustrates the core plate 100 according to the fifth embodiment from the same viewpoint as in FIG. 3. FIG. 17 is a cross section taken along a line XVII-XVII of FIG. 16.

In the present embodiment, substantially the entire first plane portion 101 is recessed toward the inside of the tank 300, whereby the rigid portion 150 is formed. That is, the rigid portion 150 of the present embodiment is provided so as to overlap the entire insertion holes 110. The present embodiment enables to produce the same effects as those described in the first embodiment.

In the present embodiment, the number of insertion holes 110 formed in one first plane portion 101, that is, the number of insertion holes 110 overlapping with the rigid portion 150 is three. Alternatively, the number of insertion holes 110 formed in one first plane portion 101 may be one as in the second embodiment shown in FIG. 12. That is, the rigid portion 150 may be provided so as to overlap the entire single insertion hole 110.

The present embodiments have been described above with reference to concrete examples. However, the present disclosure is not limited to those specific examples. Those specific examples that are appropriately modified in design by those skilled in the art are also encompassed in the scope of the present disclosure, as far as the modified specific examples have the features of the present disclosure. Each element included in each of the specific examples described above and the arrangement, condition, shape, and the like thereof are not limited to those illustrated, and can be changed as appropriate. The combinations of elements included in each of the above described specific examples can be appropriately modified as long as no technical inconsistency occurs.

What is claimed is:

1. A heat exchanger comprising:

a plurality of tubes stacked in a stacking direction, through which fluid flows; and a tank having a core plate to which each of the tubes is connected, wherein the tank includes a first space and a second space arranged in the stacking direction and separated from each other to store fluid, the core plate has insertion holes arranged in the stacking direction, through which the tubes are respectively inserted, the core plate has a boundary portion between the first space and the second space, the core plate has a plurality of rigid portions, at least one of the plurality of rigid portions located between adjacent insertion holes that are adjacent to the boundary portion so as to increase a rigidity of the core plate, each of the plurality of rigid portions arranged in the stacking direction, and extending in a width direction perpendicular to a longitudinal direction of the tube and the stacking direction, and the plurality of rigid portions include at least three rigid portions arranged in the width direction.

2. The heat exchanger according to claim 1, wherein at least one of the plurality of rigid portions is provided in each of a portion of the core plate facing the first space and a portion of the core plate facing the second space.

3. The heat exchanger according to claim 2, wherein the number of insertion holes and rigid portions in the first space and the number of insertion holes and rigid portions in the second space are equal to each other.

4. The heat exchanger according to claim 1, wherein each of the plurality of rigid portions of the core plate is recessed inward of the tank.

5. The heat exchanger according to claim 1, wherein a dummy tube through which no fluid flows is connected to the boundary portion.

6. The heat exchanger according to claim 5, wherein the plurality of rigid portions of the core plate are not located adjacent to a dummy insertion hole into which the dummy tube is inserted.

7. The heat exchanger according to claim 6, wherein a part of the core plate is recessed inward of the tank within a range between 0.5 mm and 1.5 mm.

8. The heat exchanger according to claim 1, wherein each of the plurality of rigid portions of the core plate has a concave shape recessed inward of the tank, and a position of a tip end of each of the plurality of rigid portions inside the tank is lower than a flat portion of the core plate.

9. The heat exchanger according to claim 1, wherein at least one of the plurality of rigid portions is adjacent to an end portion of the insertion holes in the width direction.

10. The heat exchanger according to claim 9, wherein at least one of the plurality of rigid portions is provided in each of a portion of the core plate facing the first space and a portion of the core plate facing the second space.

11. The heat exchanger according to claim 1, wherein at least one of the plurality of rigid portions is adjacent to a central portion of the insertion holes in the width direction.

12. The heat exchanger according to claim 1, wherein each of the plurality of rigid portions extend in the stacking direction so as to connect ends of the insertion holes in the width direction.

13. The heat exchanger according to claim 1, wherein a plane portion is defined between adjacent ones of the plurality of rigid portions in the width direction so as to be recessed from the plurality of rigid portions in the longitudinal direction of the tube.

14. The heat exchanger according to claim 13, wherein one of the plurality of rigid portions located between the plane portions in the width direction is adjacent to a central portion of the insertion holes in the width direction.

15. The heat exchanger according to claim 1, wherein each of the plurality of rigid portions extends perpendicularly to an extending direction of the insertion holes.

16. The heat exchanger according to claim 1, wherein a middle rigid portion is positioned as a middle one of the at least three rigid portions and is adjacent to a middle one of the insertion holes in the width direction.

17. The heat exchanger according to claim 1, wherein a plane portion is defined between adjacent ones of the plurality of rigid portions in the width direction, and a length of the plane portion in the width direction is longer than a length of a rigid portion located at an end of the core plate in the width direction.

* * * * *